US009790755B2

(12) United States Patent
Bourque

(10) Patent No.: US 9,790,755 B2
(45) Date of Patent: Oct. 17, 2017

(54) POSITIVE DISPLACEMENT DUMP BAILER AND METHOD OF OPERATION

(71) Applicant: Halliburton Energy Services, Inc., Houston, TX (US)

(72) Inventor: Cody Paul Bourque, Broussard, LA (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 674 days.

(21) Appl. No.: 14/259,641

(22) Filed: Apr. 23, 2014

(65) Prior Publication Data

US 2014/0318782 A1 Oct. 30, 2014

(51) Int. Cl.
*E21B 27/02* (2006.01)
*E21B 33/13* (2006.01)

(52) U.S. Cl.
CPC ..... *E21B 27/02* (2013.01); *E21B 33/13* (2013.01)

(58) Field of Classification Search
CPC ..... E21B 27/00; E21B 27/02; E21B 33/13
USPC ..... 166/286
See application file for complete search history.

(56) References Cited

U.S. PATENT DOCUMENTS 2,729,292 A * 1/1956 Hinson ..... E21B 27/00 166/163
5,469,918 A 11/1995 Haberman
7,287,591 B2 * 10/2007 Campbell ..... E21B 27/02 166/162
2010/0155054 A1 6/2010 Innes et al.
2012/0061893 A1 3/2012 Hochberg et al.
2012/0160483 A1 * 6/2012 Carisella ..... E21B 27/02 166/270

FOREIGN PATENT DOCUMENTS

GB 682742 A * 11/1952 ..... E21B 27/02
WO 0110744 2/2001

OTHER PUBLICATIONS

ISRWO, PCT/US2013/037923, KIPO, dated Jan. 17, 2014.
Dump Bailer Systems, Weatherford, 2005.

* cited by examiner

*Primary Examiner* — Nicole Coy
*Assistant Examiner* — Tara Schimpf
(74) *Attorney, Agent, or Firm* — Haynes and Boone, LLP

(57) ABSTRACT

A dump bailer assembly includes a downhole power unit and a dump bailer body. A piston is disposed within the dump bailer body and is releasably coupled to a moveable shaft of the downhole power unit. An actuation assembly is disposed proximate a first end of the dump bailer body and a barrier is positioned proximate a second end of the dump bailer body. A wellbore agent is disposed within the dump bailer body between the barrier and the piston. In operation, the downhole power unit retracts the moveable shaft shifting the piston toward the first end and energizing the actuation assembly. Further operation of the downhole power unit releases the moveable shaft from the piston such that the energized actuation assembly shifts the piston toward the second end such that interaction between the piston and the wellbore agent opens the barrier and dispenses the wellbore agent.

19 Claims, 6 Drawing Sheets

10
12
14
16
18
20
22
24
26
28
30
32
34
36
38
40
42

POSITIVE DISPLACEMENT DUMP BAILER AND METHOD OF OPERATION

CROSS-REFERENCE TO RELATED APPLICATIONS

This application claims the benefit under 35 U.S.C. §119 of the filing date of International Application No. PCT/US2013/037923, filed Apr. 24, 2013.

TECHNICAL FIELD OF THE INVENTION

This invention relates, in general, to equipment utilized in conjunction with operations performed in a subterranean well and, in particular, to a positive displacement dump bailer and a method of operating the positive displacement dump bailer.

BACKGROUND OF THE INVENTION

Without limiting the scope of the present invention, its background will be described with reference to isolating pressure between two regions in a well with a cement plug, as an example. Cement plugs are commonly set in a subterranean well at a desired location inside a casing string to isolate pressure between two regions in the well. In certain installations, this is accomplished by first, installing a bridge plug at the desired location in the casing string and then, lowered a dump bailer carrying a cement slurry into the casing on a conveyance such as a slickline, a wireline, a coiled tubing or the like. Once the dump bailer is positioned in the desired location proximate the bridge plug, the dump bailer is actuated to release the cement slurry. The cement slurry is deposited on a platform formed by the bridge plug and is supported by the bridge plug during curing.

In one type of dump bailer, gravity is used to shift a weight through the dump bailer to dispense the cement slurry from the dump bailer. It has been found, however, that such gravity operated dump bailers often fail to fully dispense the desired volume of the cement slurry from the dump bailer, which can result in cement slurry placement in undesired locations during retrieval of the dump bailer as well as additional trips into the well to add more cement. In another type of dump bailer, explosive components are used to generate pressure to dispense the cement slurry from the dump bailer. It has been found, however, that the use of explosive operated dump bailers can be undesirable due to safety concerns and their use may not be allowed in some jurisdiction due to local regulations. In a further type of dump bailer, a surface electrical power source is used to dispense the cement slurry from the dump bailer. It has been found, however, that the use of surface electrical power operated dump bailers can be undesirable due to the high deployment costs associated with the use of electric wireline packages.

Accordingly, a need has arisen for an improved dump bailer operable to release a cement slurry into a casing to isolate pressure between two regions in the well. A need has also arisen for such an improved dump bailer that does not solely rely on gravity to dispense the cement slurry. In addition, a need has arisen for such an improved dump bailer that does not require explosives to dispense the cement slurry. Further, a need has arisen for such an improved dump bailer that does not require a surface electrical power source to dispense the cement slurry.

SUMMARY OF THE INVENTION

The present invention disclosed herein is directed to an improved dump bailer assembly that is operable to release a cement slurry into a casing to isolate pressure between two regions in the well. The improved dump bailer assembly of the present invention does not solely rely on gravity to dispense the cement slurry. In addition, the improved dump bailer assembly of the present invention does not require explosives to dispense the cement slurry. Further, the improved dump bailer assembly of the present invention does not require a surface electrical power source to dispense the cement slurry.

In one aspect, the present invention is directed to a dump bailer assembly for use in a wellbore. The dump bailer assembly includes a downhole power unit having a housing and a moveable shaft. A dump bailer body is operably associated with the housing. The dump bailer body has first and second ends. A piston is disposed within the dump bailer body. The piston is releasably coupled to the moveable shaft. An actuation assembly is disposed within the dump bailer body between the first end and the piston. A barrier is operably associated with the dump bailer body and positioned proximate the second end. A wellbore agent is disposed within the dump bailer body between the barrier and the piston. In operation, the downhole power unit retracts the moveable shaft shifting the piston toward the first end to energize the actuation assembly, the downhole power unit releases the moveable shaft from the piston such that the energized actuation assembly shifts the piston toward the second end and interaction between the piston and the wellbore agent opens the barrier, thereby dispensing the wellbore agent from the dump bailer body.

In some embodiments, at least one shearable member may initially couple the piston to the moveable shaft. In certain embodiments, at least one wiper seal may be operably associated with the piston. In one embodiment, the actuation assembly may include a mechanical biasing element selected from the group consisting of coil springs, compression springs and Belleville washers. In another embodiment, the actuation assembly may include an opposing magnet assembly. In some embodiments, the barrier may be a frangible disk member. In certain embodiments, the wellbore agent may be a cement slurry. In one embodiment, the downhole power unit may have a self-contained power source for providing electrical power. In this embodiment, the downhole power unit may include an electric motor and a jackscrew assembly having a rotational member connected to a rotor of the electric motor. The rotational member may be operably associated with the moveable shaft to impart longitudinal motion thereto.

In another aspect, the present invention is directed to a dump bailer assembly for use in a wellbore. The dump bailer assembly includes a downhole power unit having a housing, a moveable shaft, a self-contained power source for providing electrical power, an electric motor having a rotor and a jackscrew assembly having a rotational member connected to the rotor. The rotational member is operably associated with the moveable shaft to impart longitudinal motion thereto. A dump bailer body is operably associated with the housing. The dump bailer body has first and second ends. A piston is disposed within the dump bailer body. The piston is releasably coupled to the moveable shaft by at least one shearable member. An actuation assembly is disposed within the dump bailer body between the first end and the piston. A barrier is operably associated with the dump bailer body and positioned proximate the second end. A wellbore agent is disposed within the dump bailer body between the barrier and the piston. In operation, the downhole power unit retracts the moveable shaft shifting the piston toward the first end to energize the actuation assembly, the downhole power unit breaks the at least one shearable member releasing the moveable shaft from the piston such that the energized actuation assembly shifts the piston toward the second end and interaction between the piston and the wellbore agent opens the barrier, thereby dispensing the wellbore agent from the dump bailer body.

In a further aspect, the present invention is directed to a method for operating a dump bailer assembly in a wellbore. The method includes disposing the dump bailer assembly at a target location in the wellbore, the dump bailer assembly including a downhole power unit having a housing and a moveable shaft and a dump bailer body operably associated with the housing; operating the downhole power unit to retract the moveable shaft; shifting a piston disposed within the dump bailer body toward a first end of the dump bailer body with the moveable shaft; energizing an actuation assembly disposed within the dump bailer body responsive to shifting the piston; releasing the moveable shaft from the piston responsive to continued operation of the downhole power unit; shifting the piston toward a second end of the dump bailer body with the energized actuation assembly; opening a barrier, operably associated with the dump bailer body and positioned proximate the second end, responsive to interaction between the piston and a wellbore agent disposed within the dump bailer body between the barrier and the piston; and dispensing the wellbore agent from the dump bailer body.

The method may also include operating an electrical motor powered by a self-contained power source of the downhole power unit; energizing a mechanical biasing element selected from the group consisting of coil springs, compression springs and Belleville washers; energizing an opposing magnet assembly; breaking at least one shearable member initially coupling the piston to the moveable shaft; and/or dispensing a cement slurry.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
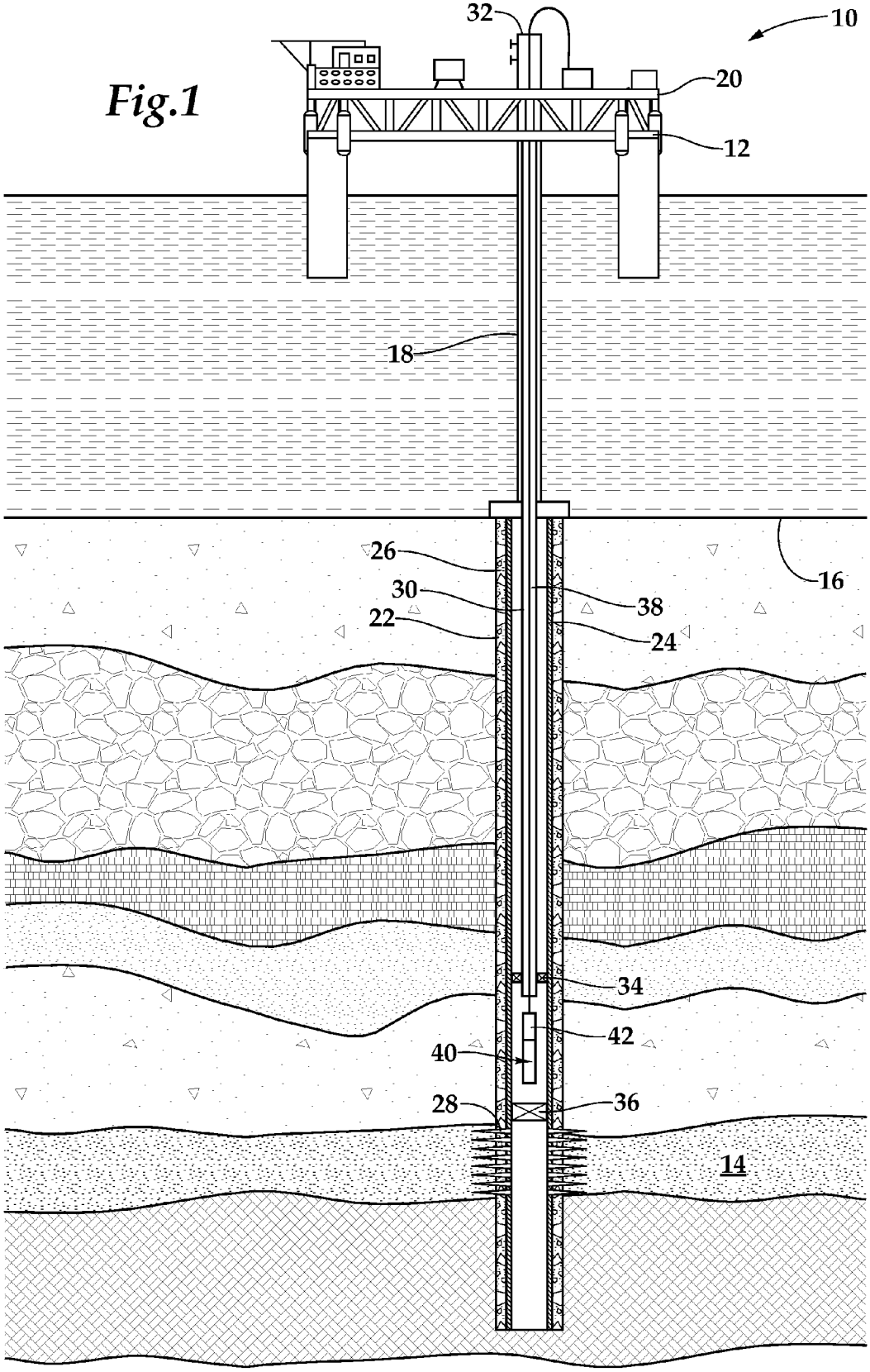
FIG. 1 is a schematic illustration of an offshore oil and gas platform during the deployment of a dump bailer assembly according to an embodiment of the present invention.

Referring initially to FIG. 1, a dump bailer assembly of the present invention is being deployed from an offshore oil and gas platform that is schematically illustrated and generally designated 10. A semi-submersible platform 12 is centered over submerged oil and gas formations 14 located below sea floor 16. A subsea conductor 18 extends from deck 20 of platform 12 to sea floor 16. A wellbore 22 extends from sea floor 16 and traverse formations 14. Wellbore 22 includes a casing 24 that is supported therein by cement 26. Hydraulic communication between the interior of casing 24 and formation 14 has been established by perforations 28.

A tubing string 30 extends from wellhead 32 into casing 24 to a location uphole of formation 14 to provide a conduit for production fluids to travel to the surface. A packer 34 provides a fluid seal between tubing string 30 and casing 24 and directs the flow of production fluids from formation 14 to the interior of tubing string 30. A through tubing bridge plug 36 has been previously installed in casing 24 below tubing string 30 as a first step in plugging and abandoning wellbore 22. Extending from the surface within tubing string 30 is a slickline 38 used to convey a tool system including a dump bailer assembly 40. Even though dump bailer assembly 40 is depicted as being deployed on a slickline, it is to be understood by those skilled in the art that dump bailer assembly 40 could be deployed on other types of conveyances, including, but not limited to, a wireline, coiled tubing, jointed tubing, a downhole robot or the like, without departing from the principles of the present invention.

In the illustrated embodiment, dump bailer assembly 40 includes a downhole power unit 42. As will be described in more detail below, a particular implementation of downhole power unit 42 includes an elongated housing, a motor disposed in the housing and a sleeve connected to a rotor of the motor. The sleeve is a rotational member that rotates with the rotor. A moveable member such as the above-mentioned moveable shaft is received within the threaded interior of the sleeve. Operation of the motor rotates the sleeve, which causes the moveable shaft to move longitudinally. Accordingly, when downhole power unit 42 is operably coupled within dump bailer assembly 40 and the moveable member is activated, longitudinal movement is imparted to a piston within dump bailer assembly 40 which energizes an actuation assembly of dump bailer assembly 40 enabling dispensing of a cement slurry from dump bailer assembly 40 into casing 24 on a platform created by through tubing bridge plug 36. Even though dump bailer assembly 40 is described as dispensing a cement slurry into casing 24, it is to be understood by those skilled in the art that dump bailer assembly 40 could be alternatively be used to dispense other wellbore agents including, but not limited to, acids, sands or the like.

In one implementation, a microcontroller made of suitable electrical components to provide miniaturization and durability within the high pressure, high temperature environments which can be encountered in an oil or gas well is used to control the operation of downhole power unit 42. The microcontroller is preferably housed within the structure of downhole power unit 42, it can, however, be connected outside of downhole power unit 42 but within the associated tool string moved into wellbore 22. In whatever physical location the microcontroller is disposed, it is operationally connected to downhole power unit 42 to control movement of the moveable member when desired. The microcontroller may include a microprocessor that initiates operation responsive to a timing device or other circuitry and contains a program stored in a memory. The program instructions cause the microprocessor to control operations of the downhole power unit 42.

The microcontroller operates under power from a power supply, which is preferably located within downhole power unit 42. The power source provides the electrical power to both the motor of downhole power unit 42 and the microcontroller. When downhole power unit 42 is at the target location, the microcontroller commences operation of downhole power unit 42 as programmed. For example, with regard to controlling the motor that operates the sleeve receiving the moveable member, the microcontroller sends a command to energize the motor to rotate the sleeve in the desired direction to retract the moveable member at the desired speed. One or more sensors monitor the operation of downhole power unit 42 and provide responsive signals to the microcontroller. When the microcontroller determines that a desired result has been obtained, it stops operation of downhole power unit 42, such as by de-energizing the motor. Alternatively, the operation of downhole power unit 42 may be controlled from the surface wherein command signals may be provided to downhole power unit 42 via a wired or wireless communication protocol. Similarly, power may be provided to downhole power unit 42 from the surface via an electrical conductor.

Even though FIG. 1 depicts a vertical well, it should be understood by those skilled in the art that the present invention is equally well-suited for use in wells having other configurations including deviated wells, inclined wells, horizontal wells, multilateral wells and the like. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Likewise, even though FIG. 1 depicts an offshore operation, it should be understood by those skilled in the art that the present invention is equally well suited for use in onshore operations. Also, even though FIG. 1 depicts a cased wellbore, it should be understood by those skilled in the art that the present invention is equally well suited for use in open hole operations.

Figure 2A:
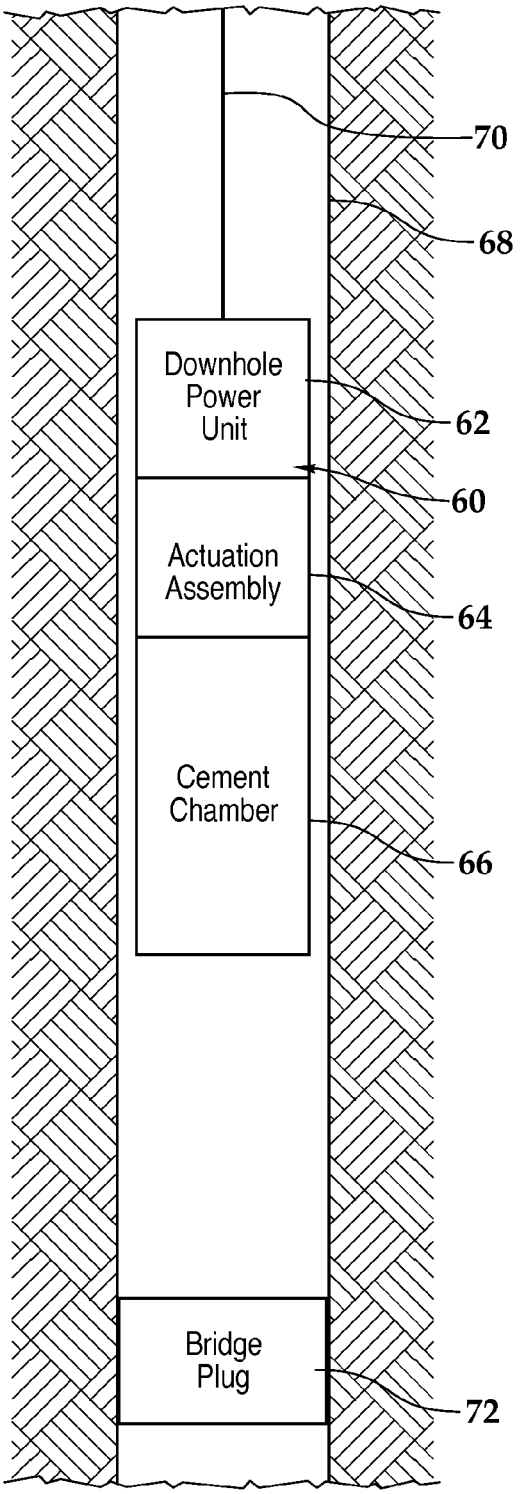
FIGS. 2A-2B are schematic illustrations of a dump bailer assembly according to an embodiment of the present invention before and after operation thereof, respectively.
Figure 2B:
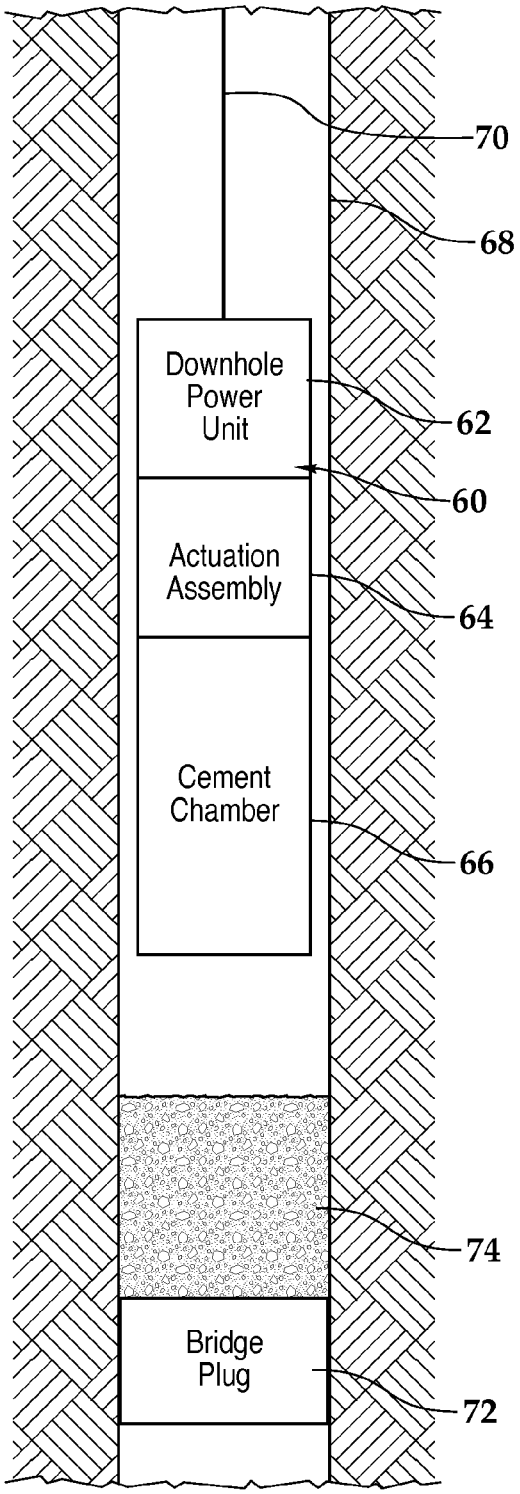

Referring next to FIGS. 2A-2B, therein is schematically depicted a dump bailer assembly of the present invention that is generally designated 60. In the illustrated embodiment, dump bailer assembly 60 includes a downhole power unit 62, an actuation assembly 64 and a cement chamber 66. Downhole power unit 62 has a moveable member described herein as a moveable shaft that is operably associated with and extends through actuation assembly 64 and that couples to a piston disposed within cement chamber 66. Dump bailer assembly 60 is illustrated as having been lowered into a well 68 on a conveyance 70 such as a slickline, a wireline, coiled tubing, jointed pipe or other tubing string.

In the illustrated embodiment, dump bailer assembly 60 has reached its target location in well 68 at a location proximate a preinstalled bridge plug 72. Operation of dump bailer assembly 60 may now commence. Based upon a predetermined time, a command signal from the surface or other input signal, downhole power unit 62 initiates the process by retracting the moveable shaft. This operation shifts the piston toward the top of dump bailer assembly 60. As the piston is shifted, actuation assembly 64 of dump bailer assembly 60 is energized as will be explained in greater detail below. The continued operation of downhole power unit 62 causes the moveable shaft to release from the piston. Thereafter, the energized actuation assembly 64 acts on the piston to shift the piston toward the bottom of dump bailer assembly 60. The impact of the piston on an upper surface of the cement slurry contained within cement chamber 66 causes a barrier on the lower end of dump bailer assembly 60 to open. The downward movement of the piston in now able to urge the cement slurry out of dump bailer assembly 60 and dispense the cement slurry into well 68 and on bridge plug 72 to form a cement plug 74, which is allowed to cure on bridge plug 72. Following operation, dump bailer assembly 60 can be retrieved to the surface.

Figure 3A:
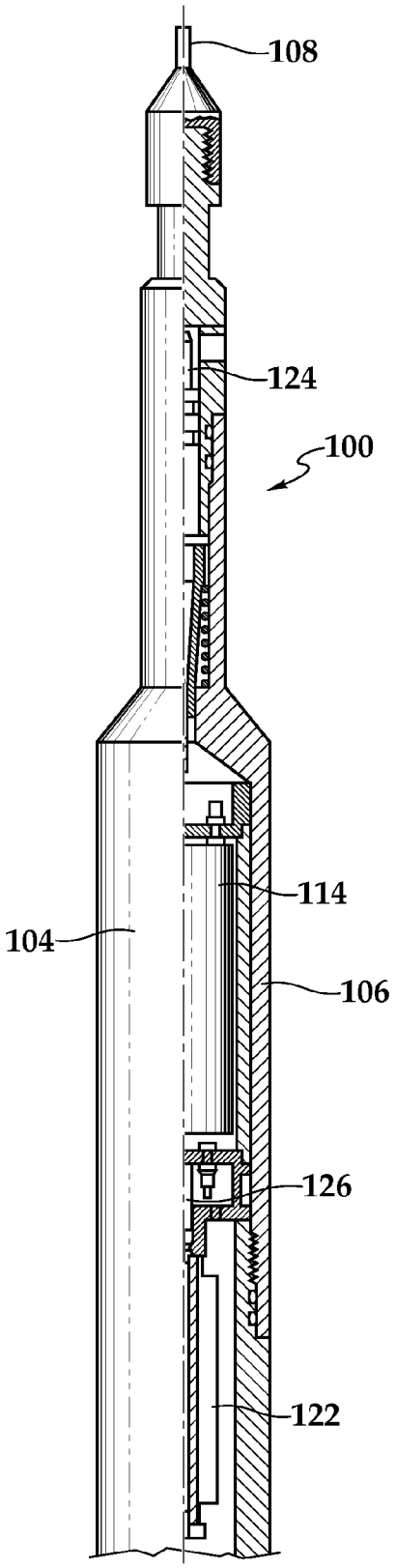
FIGS. 3A-3B are quarter sectional views of successive axial sections of a downhole power unit for use in a dump bailer assembly according to an embodiment of the present invention.
Figure 3B:
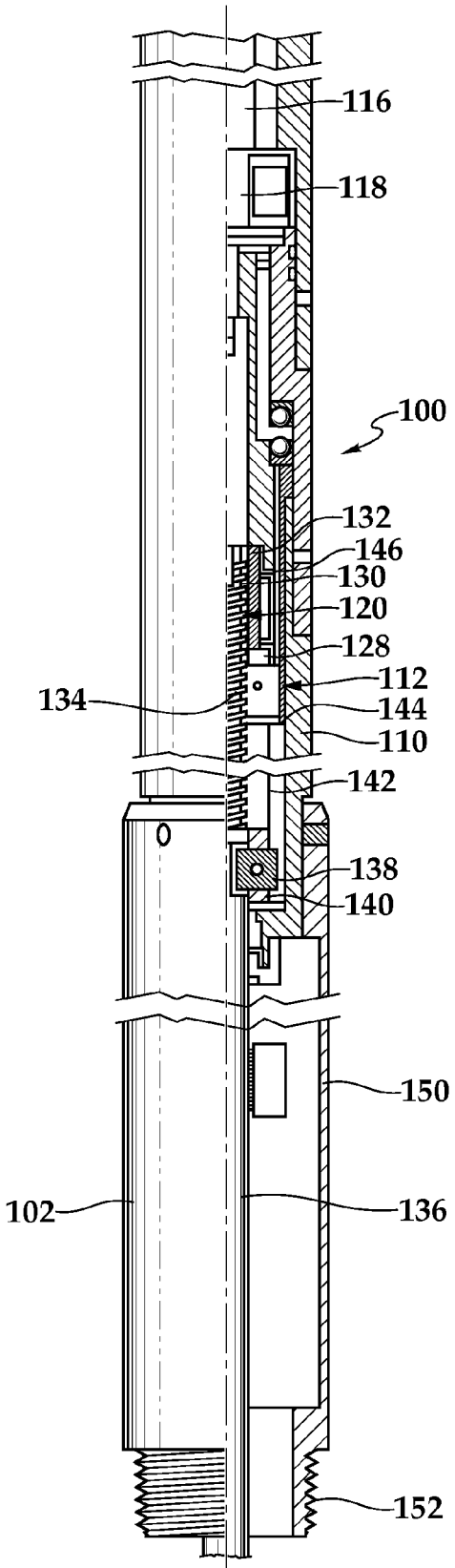

Referring now to FIGS. 3A-3B, therein are depicted successive axial sections of an exemplary downhole power unit that is generally designated 100 and that is capable of operations as part of a dump bailer assembly of the present invention. Downhole power unit 100 includes a working assembly 102 and a power assembly 104. Power assembly 104 includes a housing assembly 106, which comprises suitably shaped and connected generally tubular housing members. An upper portion of housing assembly 106 includes an appropriate mechanism to facilitate coupling of housing 106 to a conveyance 108 such as a slickline, wireline, electric line, coiled tubing, jointed tubing or the like. Housing assembly 106 also includes a clutch housing 110, which forms a portion of a clutch assembly 112.

In the illustrated embodiment, power assembly 104 includes a self-contained power source, eliminating the need for power to be supplied from an exterior source, such as a source at the surface. A preferred power source comprises a battery assembly 114 which may include a plurality of batteries such as alkaline batteries, lithium batteries or the like. Alternatively, however, power may be provided to downhole power unit 100 from the surface via an electrical conductor. Connected with power assembly 104 is the force generating and transmitting assembly. The force generating and transmitting assembly of this implementation includes a direct current (DC) electric motor 116 coupled through a gearbox 118 to a jackscrew assembly 120. A plurality of activation mechanisms 122, 124, 126 can be electrically coupled between battery assembly 114 and electric motor 116. Electric motor 116 may be of any suitable type. One example is a motor operating at 7500 revolutions per minute (rpm) in unloaded condition and operating at approximately 5000 rpm in a loaded condition, having a horsepower rating of approximately 1/30th of a horsepower. In this implementation, motor 116 is coupled through the gearbox 118, which provides approximately 5000:1 gear reduction. Gearbox 118 is coupled through a conventional drive assembly 128 to jackscrew assembly 120.

Jackscrew assembly 120 includes a moveable shaft 130 which moves longitudinally, rotates or both, in response to rotation of a sleeve assembly 132. Shaft 130 includes a threaded portion 134, and a generally smooth, polished lower extension 136. Shaft 130 further includes a pair of generally diametrically opposed keys 138 that cooperate with a clutch block 140, which is coupled to shaft 130. Clutch housing 110 includes a pair of diametrically opposed keyways 142 which extend along at least a portion of the possible length of travel. Keys 138 extend radially outwardly from shaft 130 through clutch block 140 to engage each of keyways 142 in clutch housing 110, thereby selectively preventing rotation of shaft 130 relative to housing 110.

Rotation of sleeve assembly 132 in one direction causes shaft 130 and clutch block 140 to move longitudinally upwardly relative to housing assembly 110 if shaft 130 is not at its uppermost limit. Rotation of the sleeve assembly 132 in the opposite direction moves shaft 130 downwardly relative to housing 110 if shaft 130 is not at its lowermost position. Above a certain level within clutch housing 110, as indicated generally at 144, clutch housing 110 includes a relatively enlarged internal diameter bore 146 such that moving clutch block 140 above level 144 removes the outwardly extending key 138 from being restricted from rotational movement. Accordingly, continuing rotation of sleeve assembly 132 causes longitudinal movement of shaft 130 until clutch block 140 rises above level 144, at which point rotation of sleeve assembly 132 will result in free rotation of shaft 130. By virtue of this, clutch assembly 112 serves as a safety device to prevent burn-out of the electric motor and also serves as a stroke limiter. In a similar manner, clutch assembly 112 may allow shaft 130 to rotate freely during certain points in the longitudinal travel of shaft 130.

In the illustrated embodiment, downhole power unit 100 incorporates three discrete activation assemblies, separate from or part of the microcontroller discussed above. The activation assemblies enable jackscrew 120 to operate upon the occurrence of one or more predetermined conditions. One depicted activation assembly is timing circuitry 122 of a type known in the art. Timing circuitry 122 is adapted to provide a signal to the microcontroller after passage of a predetermined amount of time. Further, downhole power unit 100 can include an activation assembly including a pressure-sensitive switch 124 of a type generally known in the art which will provide a control signal, for example, once the switch 124 reaches a depth at which it encounters a predetermined amount of hydrostatic pressure within the tubing string or experiences a particular pressure variation or series of pressure variations. Still further, downhole power unit 100 can include a motion sensor 126, such as an accelerometer or a geophone that is sensitive to vertical motion of downhole power unit 100. Accelerometer 126 can be combined with timing circuitry 122 such that when motion is detected by accelerometer 126, timing circuitry 122 is reset. If so configured, the activation assembly operates to provide a control signal after accelerometer 126 detects that downhole power unit 100 has remained substantially motionless within the well for a predetermined amount of time.

Working assembly 102 includes an outer sleeve member 150 which may be threadably coupled or pinned to housing assembly 106. At its lower end 152, outer sleeve member 150 may be threadably coupled to other tools such as a housing member of a dump bailer body. Shaft 130 extends through sleeve member 150 and is operable for coupling to other tools such as a piston disposed within a dump bailer body as will be described below.

In operation, downhole power unit 100 is adapted to cooperate directly with a housing member of a dump bailer body. Specifically, prior to run in, outer sleeve member 150 of downhole power unit 100 is operably associated with an outer housing of the dump bailer body. Likewise, shaft 130 of downhole power unit 100 is operably associated with a piston disposed within dump bailer body. As used herein, the term operably associated with shall encompass direct coupling such as via a threaded connection, a pinned connection, a frictional connection, a closely received relationship and may also include the use of set screws or other securing means which may or may not be shearable. In addition, the term operably associated with shall encompass indirect coupling such as via a connection sub, an adaptor or other coupling means. As such, an upward longitudinal movement of shaft 130 of downhole power unit 100 exerts an upward longitudinal force upon the component to which it is operably associated that initiates the operation of the dump bailer assembly.

As will be appreciated from the above discussion, actuation of motor 116 by activation assemblies 122, 124, 126 or another device and control of motor 116 by the microcontroller results in the required longitudinal movement of shaft 130. As described below, shaft 130 is required to retract a distance that is sufficient to energize an actuation assembly and then further to cause release of shaft 130 from the piston. Preferably, downhole power unit 100 is preprogrammed to perform the proper operations prior to deployment into the well. Alternatively, downhole power unit 100 may receive command signals from the surface via wired or wireless telemetry. Once the dump bailing operation has been performed, downhole power unit 100 and the other dump bailer components, may be retrieved to the surface. Even though a particular downhole power unit has been depicted and described, it should be clearly understood by those skilled in the art that other types of downhole power devices could alternatively be used with a dump bailer assembly without departing from the principles of the present invention.

Referring now to FIGS. 4A-4D, a lower portion of a dump bailer assembly according to an embodiment of the present invention is depicted in its various operating positions and is generally designated 200. In the illustrated embodiment, dump bailer assembly 200 includes a dump bailer body 202 in the form of a generally tubular outer housing. At its upper end, dump bailer body 202 includes a threaded connector 204 that is operable to be threadably secured to another tool such as outer sleeve member 150 of downhole power unit 100. The upper portion of dump bailer body 202 houses an actuation assembly 206. In the illustrated embodiment, actuation assembly 206 includes a biasing member 208 depicted as a series-parallel Belleville washer assembly. Even though a particular biasing member has been depicted and described, it should be clearly understood by those skilled in the art that other types of biasing member including, but not limited to, mechanical springs, series Belleville washers, parallel Belleville washers, compression springs, coil springs, fluid springs and the like, could alternatively be used without departing from the principles of the present invention. Actuation assembly 206 also includes a spring support member 210 that provides a surface that defines the upper limit of movement for biasing member 208.

Figures 4A, 4B, 4C, 4D:
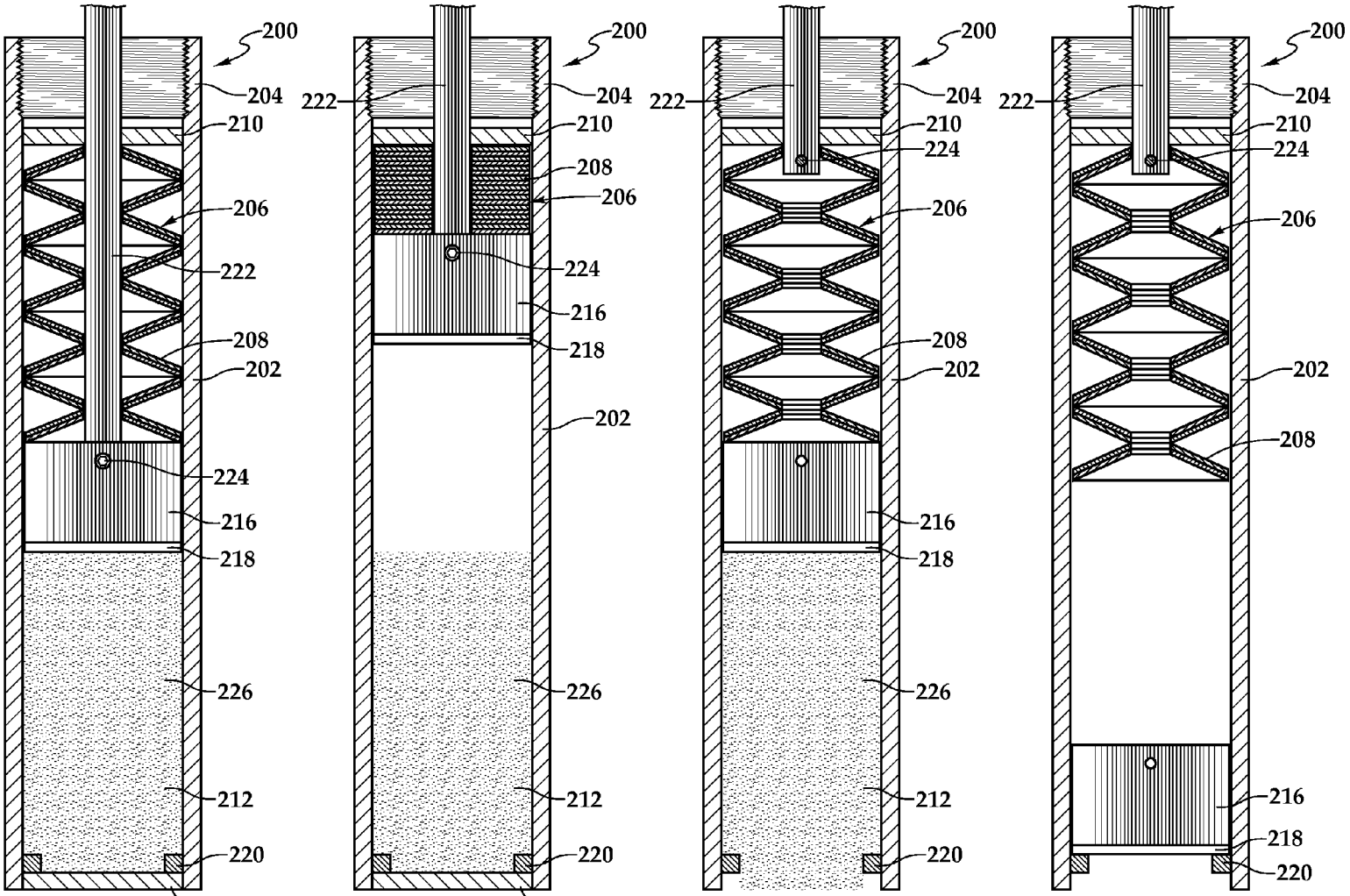
FIGS. 4A-4D are cross sectional views of a lower portion of a dump bailer assembly according to an embodiment of the present invention in its various operating positions.

The lower portion of dump bailer body 202 houses a cement chamber 212. In the illustrated embodiment, the lower end of cement chamber 212 is defined by a barrier 214 depicted as a disk member that may be in the form of a metal rupture disk, a frangible ceramic disk or other suitably removable disk member. The upper end of cement chamber 212 is defined by a piston 216. Piston 216 includes one or more wiper seals 218 that preferably have a sealing engagement with the inner surface of dump bailer body 202. A piston travel limiter 220 is disposed within dump bailer body 202 that defines the lower limit of movement for piston 216. Piston 216 is coupled to shaft 222 via one or more shearable members depicted as shear screws 224. Shaft 222 may be the lower end of shaft 130 of downhole power unit 100 or may be a connector that extends the length of shaft 130 of downhole power unit 100. Even though the coupling between piston 216 and shaft 222 has been depicted and described as shear screws 224, it should be clearly understood by those skilled in the art that other types of releasable couplings including, but not limited to, shear threads, c-rings, dogs and the like, could alternatively be used without departing from the principles of the present invention. In the running configuration of dump bailer body 202, as best seen in FIG. 4A, a cement slurry 226 is disposed within cement chamber 212 between barrier 214 and the lower surface of piston 216.

The operation of dump bailer assembly 200 will now be described. Once dump bailer assembly 200 including downhole power unit 100 is disposing a target location in the wellbore, operation of downhole power unit 100 may commence as described above. This actuation causes shaft 222 to move upwardly relative to dump bailer body 202. As shaft 222 is initially coupled to piston 216, this assembly is shifted upwardly together. The upward movement compresses biasing member 208 of actuation assembly 206, thereby energizing actuation assembly 206, as best seen in FIG. 4B. Continued operation of downhole power unit 100 generates the required shear force to break shear screws 224 that couple piston 216 and shaft 222. Once piston 216 is released from shaft 222, the energized actuation assembly 206 acts on piston 216 causing piston 216 to move downwardly relative to dump bailer body 202. As best seen in FIG. 4C, at or near the time piston 216 contacts an upper surface of cement slurry 226, an opening is created in barrier 214 by breaking, shattering or otherwise removing barrier 214 responsive to the impact or pressure change created due to interaction of piston 216 with cement slurry 226. Thereafter, continued downward movement of piston 216 relative to dump bailer body 202 responsive to the force generated by the energized actuation assembly 206 dispenses cement slurry 226 from dump bailer body 202, as best seen in FIG. 4D.

Referring now to FIGS. 5A-5D, a lower portion of a dump bailer assembly according to an embodiment of the present invention is depicted in its various operating positions and is generally designated 300. In the illustrated embodiment, dump bailer assembly 300 includes a dump bailer body 302 in the form of a generally tubular outer housing. At its upper end, dump bailer body 302 includes a threaded connector 304 that is operable to be threadably secured to another tool such as outer sleeve member 150 of downhole power unit 100. The upper portion of dump bailer body 302 houses an actuation assembly 306. In the illustrated embodiment, actuation assembly 306 includes an opposing magnet assembly depicted as lower magnet member 308 and upper magnet member 310.

Figure 5D:
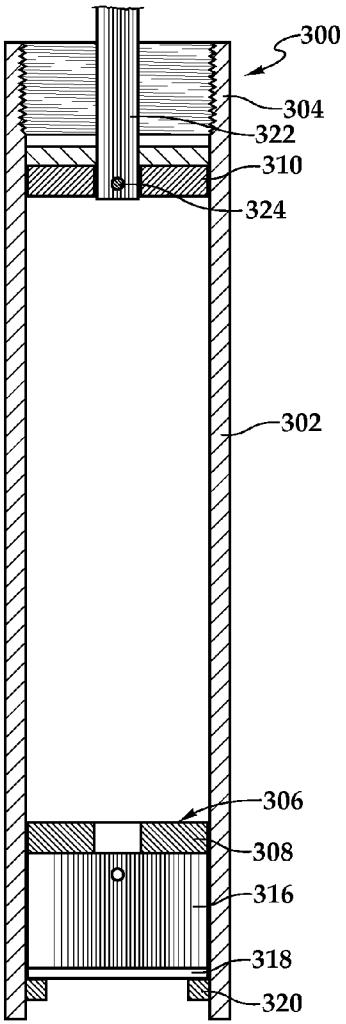
FIGS. 5A-5D are cross sectional views of a lower portion of a dump bailer assembly according to an embodiment of the present invention in its various operating positions.
Figure 5C:
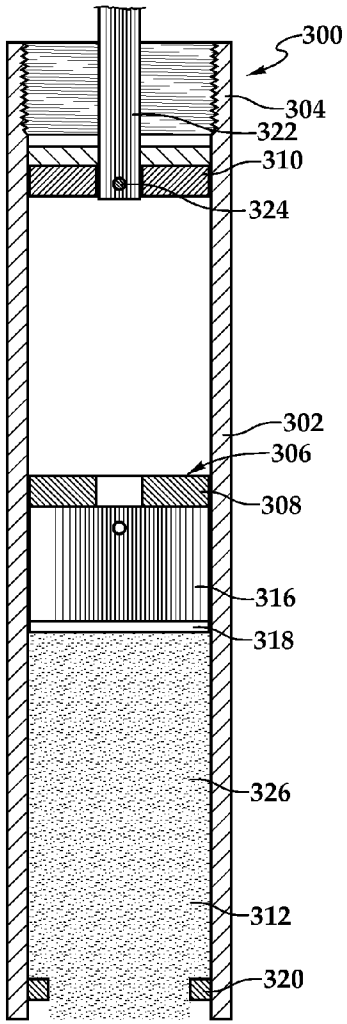
Figure 5B:
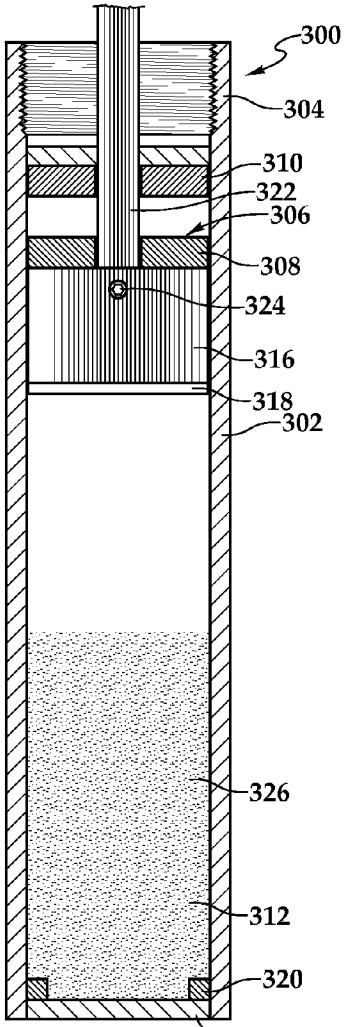
Figure 5A:
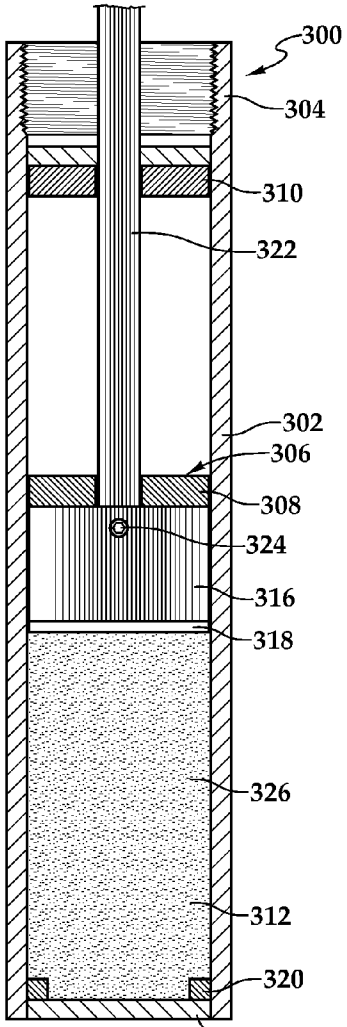

The lower portion of dump bailer body 302 houses a cement chamber 312. In the illustrated embodiment, the lower end of cement chamber 312 is defined by a barrier 314 depicted as a disk member. The upper end of cement chamber 312 is defined by a piston 316. Piston 316 includes one or more wiper seals 318 that preferably have a sealing engagement with the inner surface of dump bailer body 302. A piston travel limiter 320 is disposed within dump bailer body 302 that defines the lower limit of movement for piston 316. Piston 316 is coupled to shaft 322 via one or more shearable members depicted as shear screws 324. Shaft 322 may be the lower end of shaft 130 of downhole power unit 100 or may be a connector that extends the length of shaft 130 of downhole power unit 100. In the running configuration of dump bailer body 302, as best seen in FIG. 5A, a cement slurry 326 is disposed within cement chamber 312 between barrier 314 and the lower surface of piston 316.

The operation of dump bailer assembly 300 will now be described. Once dump bailer assembly 300 including downhole power unit 100 is disposing a target location in the wellbore, operation of downhole power unit 100 may commence as described above. This actuation causes shaft 322 to move upwardly relative to dump bailer body 302. As shaft 322 is initially coupled to piston 316, this assembly is shifted upwardly together. The upward movement shifts lower magnet member 308 toward upper magnet member 310 of actuation assembly 306, thereby energizing actuation assembly 306, as best seen in FIG. 5B. Continued operation of downhole power unit 100 generates the required shear force to break shear screws 324 that couple piston 316 and shaft 322. Once piston 316 is released from shaft 322, the energized actuation assembly 306 acts on piston 316 causing piston 316 to move downwardly relative to dump bailer body 302. As best seen in FIG. 5C, at or near the time piston 316 contacts an upper surface of cement slurry 326, an opening is created in barrier 314 by breaking, shattering or otherwise removing barrier 314 responsive to the impact or pressure change created due to interaction of piston 316 with cement slurry 326. Thereafter, continued downward movement of piston 316 relative to dump bailer body 302 responsive to the force generated by the energized actuation assembly 306 dispenses cement slurry 326 from dump bailer body 302, as best seen in FIG. 5D.

Figure 6A:
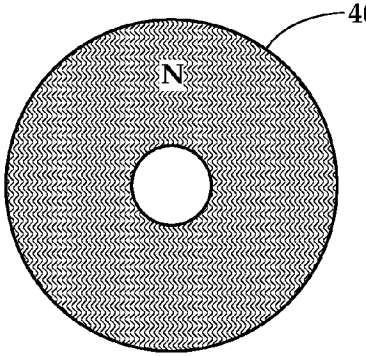
FIGS. 6A-6B are schematic illustrations of components for an opposing magnet assembly for use in a dump bailer assembly according to an embodiment of the present invention.
Figure 6B:
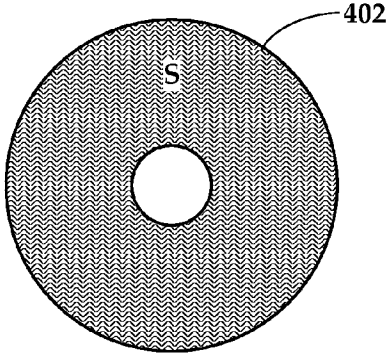

Referring now to FIGS. 6A-6B, therein is schematic depicted components for an opposing magnet assembly for use in a dump bailer assembly according to an embodiment of the present invention. In the illustrated embodiment, the upper surface of a lower magnet member 400 is depicted in FIG. 6A and the lower surface of an upper magnet member 402 is depicted in FIG. 6B. The two illustrated surfaces form facing surfaces of the opposing magnet assembly containing lower magnet member 400 and upper magnet member 402. As such, when lower magnet member 400 and upper magnet member 402 are in their operating configuration, the facing surfaces have opposite polarity. The magnetic repulsion between lower magnet member 400 and upper magnet member 402 creates an increasing axial force that acts on the piston of the dump bailer assembly as lower magnet member 400 is shifted toward upper magnet member 402 during the energizing process. This magnetic repulsion force then serves as the energy source to shift the piston toward the cement slurry and the bottom of the dump bailer assembly after the piston is released from the shaft of the downhole power unit.

Figure 7A:
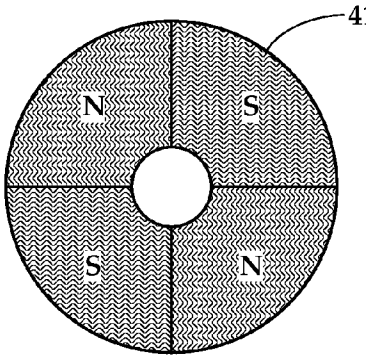
FIGS. 7A-7B are schematic illustrations of components for an opposing magnet assembly for use in a dump bailer assembly according to an embodiment of the present invention.
Figure 7B:
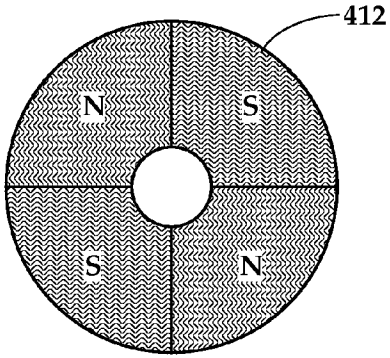

Referring now to FIGS. 7A-7B, therein is schematic depicted components for an opposing magnet assembly for use in a dump bailer assembly according to an embodiment of the present invention. In the illustrated embodiment, the upper surface of a lower magnet member 410 is depicted in FIG. 7A and the lower surface of an upper magnet member 412 is depicted in FIG. 7B. Lower magnet member 410 includes a four member array of magnets having alternating poles. Likewise, upper magnet member 412 includes a four member array of magnets having alternating poles. The two illustrated surfaces form facing surfaces of the opposing magnet assembly containing lower magnet member 410 and upper magnet member 412. As such, when lower magnet member 410 and upper magnet member 412 are in their operating configuration, the facing surfaces of the magnets in each of the four member arrays have opposite polarities. The magnetic repulsion between lower magnet member 410 and upper magnet member 412 creates an increasing axial force that acts on the piston of the dump bailer assembly as lower magnet member 410 is shifted toward upper magnet member 412 during the energizing process. This magnetic repulsion force then serves as the energy source to shift the piston toward the cement slurry and the bottom of the dump bailer assembly after the piston is released from the shaft of the downhole power unit.

Figure 8A:
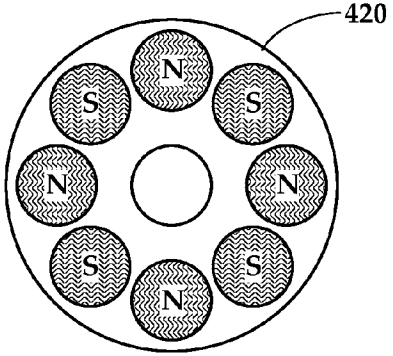
FIGS. 8A-8B are schematic illustrations of components for an opposing magnet assembly for use in a dump bailer assembly according to an embodiment of the present invention.
Figure 8B:
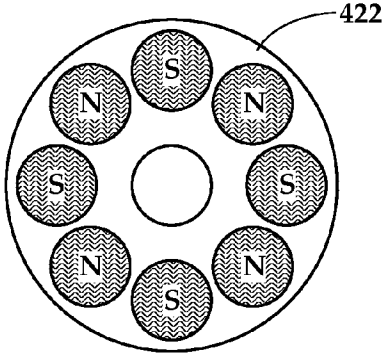

Referring now to FIGS. 8A-8B, therein is schematic depicted components for an opposing magnet assembly for use in a dump bailer assembly according to an embodiment of the present invention. In the illustrated embodiment, the upper surface of a lower magnet member 420 is depicted in FIG. 8A and the lower surface of an upper magnet member 422 is depicted in FIG. 8B. Lower magnet member 420 includes an eight member array of magnets having alternating poles. Likewise, upper magnet member 422 includes an eight member array of magnets having alternating poles. The two illustrated surfaces form facing surfaces of the opposing magnet assembly containing lower magnet member 420 and upper magnet member 422. As such, when lower magnet member 420 and upper magnet member 422 are in their operating configuration, the facing surfaces of the magnets in each of the eight member arrays have opposite polarities. The magnetic repulsion between lower magnet member 420 and upper magnet member 422 creates an increasing axial force that acts on the piston of the dump bailer assembly as lower magnet member 420 is shifted toward upper magnet member 422 during the energizing process. This magnetic repulsion force then serves as the energy source to shift the piston toward the cement slurry and the bottom of the dump bailer assembly after the piston is released from the shaft of the downhole power unit.

Figure 9A:
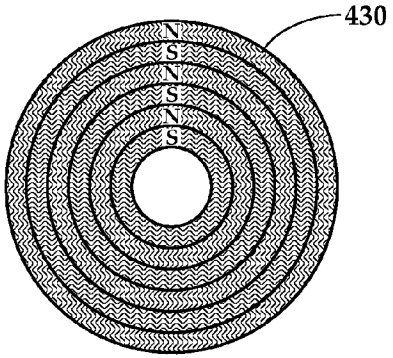
FIGS. 9A-9B are schematic illustrations of components for an opposing magnet assembly for use in a dump bailer assembly according to an embodiment of the present invention.
Figure 9B:
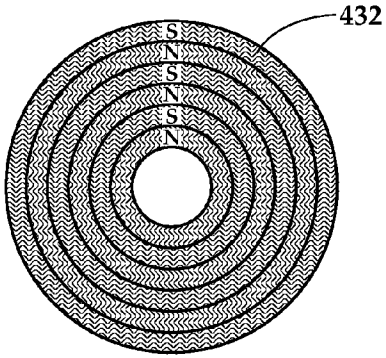

Referring now to FIGS. 9A-9B, therein is schematic depicted components for an opposing magnet assembly for use in a dump bailer assembly according to an embodiment of the present invention. In the illustrated embodiment, the upper surface of a lower magnet member 430 is depicted in FIG. 9A and the lower surface of an upper magnet member 432 is depicted in FIG. 9B. Lower magnet member 430 includes a six member array of radially spaced magnetic rings having alternating poles. Likewise, upper magnet member 432 includes a six member array of radially spaced magnetic rings having alternating poles. The two illustrated surfaces form facing surfaces of the opposing magnet assembly containing lower magnet member 430 and upper magnet member 432. As such, when lower magnet member 430 and upper magnet member 432 are in their operating configuration, the facing surfaces of the magnetic rings in each of the six member arrays have opposite polarities. The magnetic repulsion between lower magnet member 430 and upper magnet member 432 creates an increasing axial force that acts on the piston of the dump bailer assembly as lower magnet member 430 is shifted toward upper magnet member 432 during the energizing process. This magnetic repulsion force then serves as the energy source to shift the piston toward the cement slurry and the bottom of the dump bailer assembly after the piston is released from the shaft of the downhole power unit.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A dump bailer assembly for use in a wellbore comprising:

a downhole power unit having a housing and a moveable shaft;

a dump bailer body operably associated with the housing, the dump bailer body having first and second ends;

a piston disposed within the dump bailer body, the piston releasably coupled to the moveable shaft;

an actuation assembly disposed within the dump bailer body between the first end and the piston, the actuation assembly comprising a compressible mechanical biasing element;

a barrier operably associated with the dump bailer body and positioned proximate the second end; and a wellbore agent disposed within the dump bailer body between the barrier and the piston;

wherein, the downhole power unit is capable of retracting the moveable shaft to shift the piston toward the first end to energize the actuation assembly;

wherein, continued operation of the downhole power unit releases the moveable shaft from the piston such that the energized actuation assembly shifts the piston toward the second end; and wherein, interaction between the piston and the wellbore agent opens the barrier and dispenses the wellbore agent from the dump bailer body.

2. The dump bailer assembly as recited in claim 1 further comprising at least one shearable member initially coupling the piston to the moveable shaft.

3. The dump bailer assembly as recited in claim 1 further comprising at least one wiper seal operably associated with the piston.

4. The dump bailer assembly as recited in claim 1 wherein the mechanical biasing element is selected from the group consisting of coil springs, compression springs and Belleville washers.

5. The dump bailer assembly as recited in claim 1 wherein the barrier further comprises a frangible disk member.

6. The dump bailer assembly as recited in claim 1 wherein the wellbore agent further comprises a cement slurry.

7. The dump bailer assembly as recited in claim 1 wherein the downhole power unit further comprises a self-contained power source for providing electrical power.

8. The dump bailer assembly as recited in claim 1 wherein the downhole power unit further comprises:

an electric motor including a rotor; and a jackscrew assembly including a rotational member connected to the rotor, the rotational member operably associated with the moveable shaft to impart longitudinal motion to the moveable shaft.

9. A dump bailer assembly for use in a wellbore comprising:

a downhole power unit having a housing, a moveable shaft, a self-contained power source for providing electrical power, an electric motor having a rotor and a jackscrew assembly having a rotational member connected to the rotor, the rotational member operably associated with the moveable shaft to impart longitudinal motion to the moveable shaft;

a dump bailer body operably associated with the housing, the dump bailer body having first and second ends;

a piston disposed within the dump bailer body, the piston releasably coupled to the moveable shaft by at least one shearable member;

an actuation assembly disposed within the dump bailer body between the first end and the piston, the actuation assembly comprising a mechanical biasing element operably associated with the piston to exert a force on the piston to shift the piston toward the second element;

a barrier operably associated with the dump bailer body and positioned proximate the second end; and a wellbore agent disposed within the dump bailer body between the barrier and the piston;

wherein, the downhole power unit is capable of retracting the moveable shaft to shift the piston toward the first end to energize the actuation assembly;

wherein, continued operation of the downhole power unit breaks the at least one shearable member releasing the moveable shaft from the piston such that the energized actuation assembly shifts the piston toward the second end; and wherein, interaction between the piston and the wellbore agent opens the barrier and dispenses the wellbore agent from the dump bailer body.

10. The dump bailer assembly as recited in claim 9 further comprising at least one wiper seal operably associated with the piston.

11. The dump bailer assembly as recited in claim 9 wherein the mechanical biasing element is selected from the group consisting of coil springs, compression springs and Belleville washers.

12. The dump bailer assembly as recited in claim 9 wherein the actuation assembly further comprises an opposing magnet assembly.

13. The dump bailer assembly as recited in claim 9 wherein the wellbore agent further comprises a cement slurry.

14. A method for operating a dump bailer assembly in a wellbore, the method comprising:

disposing the dump bailer assembly at a target location in the wellbore, the dump bailer assembly including a downhole power unit having a housing and a moveable shaft and a dump bailer body operably associated with the housing;

operating the downhole power unit to retract the moveable shaft;

shifting a piston disposed within the dump bailer body toward a first end of the dump bailer body with the moveable shaft;

energizing an actuation assembly disposed within the dump bailer body responsive to shifting the piston, the actuation assembly comprising a mechanical biasing element;

releasing the moveable shaft from the piston responsive to continued operation of the downhole power unit;

shifting the piston toward a second end of the dump bailer body with the energized actuation assembly subsequent to releasing the moveable shaft;

opening a barrier, operably associated with the dump bailer body and positioned proximate the second end, responsive to interaction between the piston and a wellbore agent disposed within the dump bailer body between the barrier and the piston; and dispensing the wellbore agent from the dump bailer body.

15. The method as recited in claim 14 wherein operating of the downhole power unit to retract the moveable shaft further comprises operating an electrical motor powered by a self-contained power source.

16. The method as recited in claim 14 wherein the mechanical biasing element is selected from the group consisting of coil springs, compression springs and Belleville washers.

17. The method as recited in claim 14 wherein energizing the actuation assembly responsive to shifting the piston further comprises energizing an opposing magnet assembly.

18. The method as recited in claim 14 wherein releasing the moveable shaft from the piston responsive to continued operation of the downhole power unit further comprises breaking at least one shearable member initially coupling the piston to the moveable shaft.

19. The method as recited in claim 14 wherein dispensing the wellbore agent from the dump bailer body further comprises dispensing a cement slurry.

* * * * *